US006694990B2

(12) United States Patent
Spanyer et al.

(10) Patent No.: US 6,694,990 B2
(45) Date of Patent: Feb. 24, 2004

(54) DISHWASHER VARIABLE DRY CYCLE APPARATUS

(75) Inventors: Andrew Joseph Spanyer, Louisville, KY (US); Peter Andrew Riddell, Victoria (AU)

(73) Assignee: General Electric Company, Schenectady, NY (US)

( * ) Notice: Subject to any disclaimer, the term of this patent is extended or adjusted under 35 U.S.C. 154(b) by 11 days.

(21) Appl. No.: 09/682,756

(22) Filed: Oct. 15, 2001

(65) Prior Publication Data

US 2003/0079760 A1 May 1, 2003

(51) Int. Cl.[7] ..... D06F 33/02

(52) U.S. Cl. ..... 134/57 D; 134/58 D; 134/99.2; 134/105; 134/113

(58) Field of Search ..... 134/56 D, 57 D, 134/58 D, 99.2, 105, 113

(56) References Cited

U.S. PATENT DOCUMENTS

| | | | | |
|---|---|---|---|---|
| 3,876,469 A | | 4/1975 | Schimke | 134/95 |
| 3,908,681 A | | 9/1975 | Schimke et al. | 134/94 |
| 4,188,732 A | | 2/1980 | Quayle | 34/54 |
| 4,247,158 A | | 1/1981 | Quayle | 312/213 |
| 4,509,543 A | * | 4/1985 | Livingston et al. | 134/113 |
| 4,561,904 A | * | 12/1985 | Eberhardt, Jr. | 134/18 |
| 4,657,036 A | | 4/1987 | Yake | 134/95 |
| 4,756,321 A | * | 7/1988 | Livingston et al. | 134/56 D |
| 5,076,306 A | | 12/1991 | Suzuki et al. | 134/95 |
| 5,277,210 A | | 1/1994 | Kim | 134/95.2 |
| 5,331,984 A | * | 7/1994 | Isagawa | 134/108 |
| 5,337,500 A | | 8/1994 | Enokizono | 34/77 |
| 5,411,042 A | | 5/1995 | Suzuki et al. | 134/57 D |
| 5,560,060 A | * | 10/1996 | Dausch et al. | 8/158 |
| 5,586,567 A | * | 12/1996 | Smith et al. | 134/113 |
| 5,660,195 A | | 8/1997 | Taylor, Jr. et al. | 134/58 D |
| 5,875,802 A | | 3/1999 | Favaro et al. | 134/102.3 |
| 6,210,600 B1 | | 4/2001 | Zhou et al. | 252/180 |

FOREIGN PATENT DOCUMENTS

| | | | |
|---|---|---|---|
| JP | 07100089 A | * | 4/1995 |
| JP | 08019501 A | * | 8/1996 |
| JP | 11206688 A | * | 8/1999 |

* cited by examiner

*Primary Examiner*—Randy Gulakowski
*Assistant Examiner*—Joseph L. Perrin
(74) *Attorney, Agent, or Firm*—George L. Rideout, Jr., Esq.; Armstrong Teasdale LLP

(57) ABSTRACT

An apparatus and method for operating a dishwasher in a variable dry cycle mode is provided. The dishwasher includes a wash chamber, a heater element located within the wash chamber, a rinse aid product dispenser, and a fan unit for circulating air. The method comprises determining a temperature of the wash chamber, determining an amount of rinse aid product in the dispenser, and, based upon the determined temperature and the amount of rinse aid product, determining an optimized heater element cycle and an optimized fan unit cycle.

6 Claims, 3 Drawing Sheets

DISHWASHER VARIABLE DRY CYCLE APPARATUS

BACKGROUND OF INVENTION

This invention relates generally to dishwashers, and more particularly, to drying cycles for dishwashers.

Typically, known dishwashers include a cabinet housing a wash chamber wherein dishes, flatware, cups and glasses, etc. are loaded onto roller-equipped racks. Washing fluid is circulated throughout the wash chamber according to a pre-designated wash cycle executable by a control mechanism. Often, the wash cycle concludes with a dry cycle that operates a heating element located within the wash chamber, as well a forced air convection system that circulates ambient air through dishwasher vents to remove humidity from the wash chamber and dry the items located therein. Conventionally, the dry cycle consists of operating the heater element and the circulation fan for a fixed time period and opening the vent for a predetermined time period. See, for example, U.S. Pat. No. 3,908,681.

While in most cases, fixed duration heating cycles may adequately dry items in the dishwasher, certain operating conditions can render the dry cycle inadequate and/or undesirable. For example, water temperature variations in dishwasher rinse cycles, which may occur for various reasons, may lead to incompletely dried items at the end of the cycle or completely dried items well in advance of when the cycle ends. Also, rinse aid products are now available that may affect the amount of time required to dry items in the dishwasher. See, for example, U.S. Pat. No. 6,210,600 B1. Hence, the presence or absence of the rinse aid may result in dry cycles that are excessive or inefficient, respectively.

In light of stringent new energy efficiency requirements and expectations, inefficient dry cycles are undesirable for both manufacturers and consumers alike.

SUMMARY OF INVENTION

In one aspect, a method for controlling a dry cycle for a dishwasher including a wash chamber and a heater element in the wash chamber is provided. The method comprises sensing a temperature of the wash chamber, and energizing the heater element for a time dependent upon the sensed temperature.

In another aspect, a method for operating a dishwasher in a variable dry cycle mode is provided. The dishwasher includes a wash chamber, a heater element located within the wash chamber, a rinse aid product dispenser, and a fan unit for circulating air. The method comprises determining a temperature of the wash chamber, determining an amount of rinse aid product in the dispenser, and, based upon the determined temperature and the amount of rinse aid product, determining an optimized heater element cycle and an optimized fan unit cycle.

In yet another aspect, a method for operating a dishwasher in a variable dry cycle is provided. The dishwasher includes a wash chamber, a heater element in the wash chamber, a rinse aid product dispenser, a fan, and a controller. The method comprises determining operating conditions of the wash chamber and the rinse aid dispenser, and operating the heater element and the fan to execute an energy efficient dry cycle dependent upon the determined conditions of the wash chamber and the rinse aid product dispenser.

In a further aspect, a dishwasher is provided which comprises a wash chamber, a thermistor for determining a temperature of said wash chamber, a heater element located within said wash chamber, and a controller operatively coupled to said heater element and to said thermistor, said controller configured to operate the heater element for a selected time period determined by a thermistor reading.

In still a further aspect, a dishwasher is provided which comprises: a wash chamber, a thermistor for determining a temperature of said wash chamber, a heater element located within said wash chamber, a fan unit, and a controller operatively coupled to said heater element, to said thermistor, and to said fan unit. The controller is configured to execute a variable dry cycle wherein the heater element is energized for a selected time period determined by a thermistor reading and the fan is energized for a selected time period determined by the thermistor reading.

In yet an additional aspect, a dishwasher is provided which comprises a wash chamber, a thermistor for determining a temperature of said wash chamber, a heater element located within said wash chamber, a fan unit, a rinse aid product dispenser, a transducer operatively coupled to said rinse aid product for determining an amount of rinse aid product in the dispenser, and a controller operatively coupled to said heater element, to said thermistor, to said fan unit, and to said transducer. The controller is configured operate an energy efficient dry cycle wherein said fan unit and said heater element are energized for a time determined in response to signals from said thermistor and said transducer.

DETAILED DESCRIPTION

Figure 1:
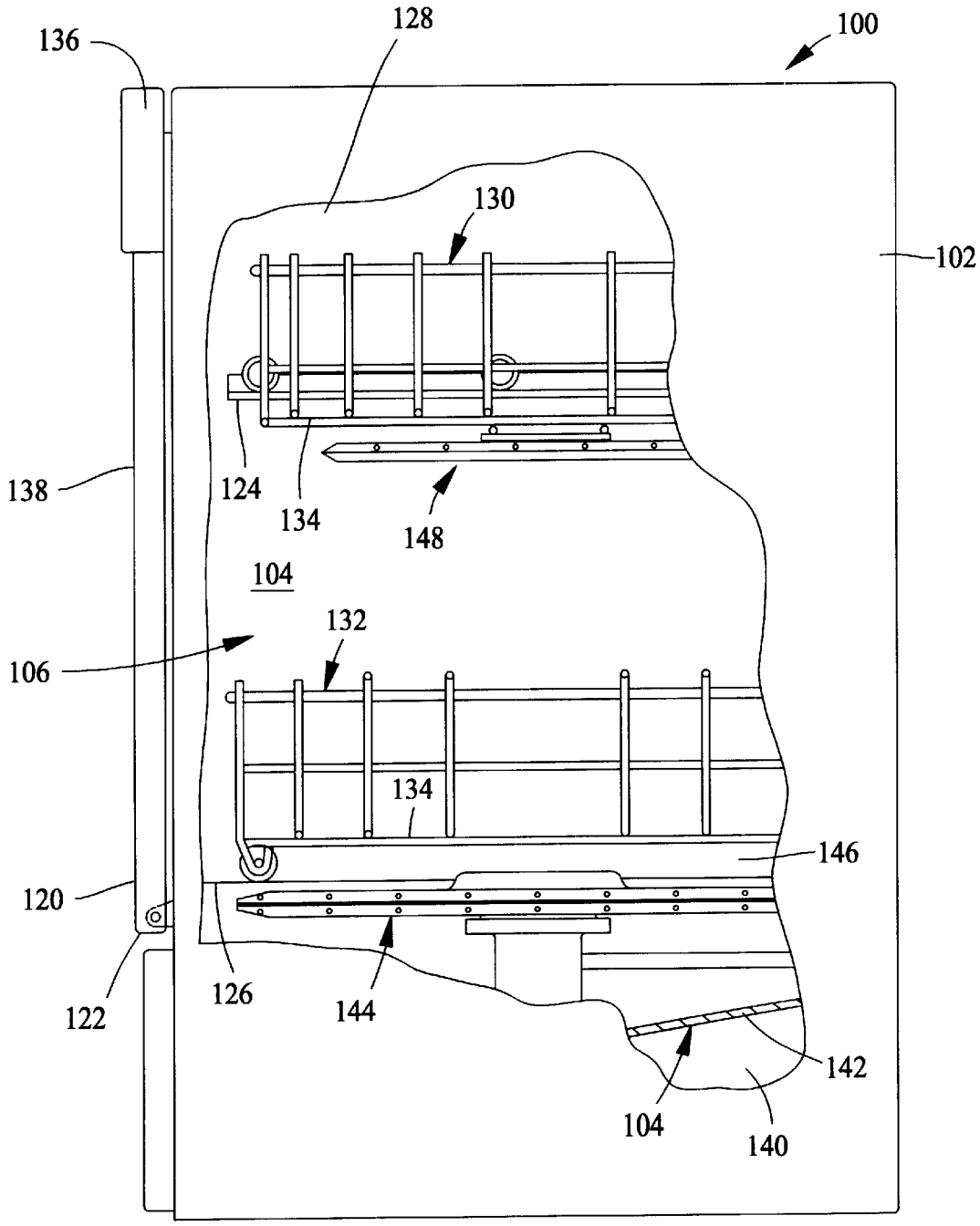
FIG. 1 is a side elevational view of an exemplary dishwasher system partially broken away.

FIG. 1 is a side elevational view of an exemplary domestic dishwasher system 100 partially broken away, and in which the present invention may be practiced. It is contemplated, however, that the cycle described herein may be practiced in other types of dishwashers and dishwasher systems beyond dishwasher system 100 described and illustrated herein. Accordingly, the following description of dishwasher 100 is for illustrative purposes only, and the invention is in no way limited to use in a particular type of dishwasher system, for example dishwasher system 100.

Dishwasher 100 includes a cabinet 102 having a tub 104 therein and forming a wash chamber 106. Tub 104 includes a front opening (not shown in FIG. 1) and a door assembly 120 hinged at its bottom 122 for movement between a normally closed vertical position (shown in FIG. 1) wherein wash chamber 106 is sealed shut for washing operation, and a horizontal open position (not shown) for loading and unloading of dishwasher contents. Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control panel (not shown in FIG. 1) is integrated into an escutcheon 136 that is mounted to door assembly 120, or in further and/or alternative embodiments control selectors, (e.g., buttons, switches or knobs) or control displays, etc. may be mounted at a convenient location on an outer face 138 of door assembly 120. The control panel and associated selectors and displays are coupled to known control circuitry (not shown) and control mechanisms (not shown in FIG. 1) for operating a fluid circulation assembly (not shown in FIG. 1) that circulates water and dishwasher fluid in dishwasher tub 104. The fluid circulation assembly is located in a machinery compartment 140 located below a bottom sump portion 142 of tub 104.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 and is located in close proximity to upper rack 130 and at a sufficient height above lower rack 132 to accommodate a largest item, such as a dish or platter (not shown), that is expected to be placed in lower rack 132 and washed in dishwasher system 100. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130,132, respectively. The arrangement of the discharge ports in at least lower spray-arm assembly 144 provides a rotational force by virtue of washing fluid flowing through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated and door assembly 120 is properly closed to seal wash chamber 106 for operation.

During operation, and at the conclusion of a wash cycle, a dry cycle mode of operation is typically commenced that energizes a resistive heating element (not shown in FIG. 1) to warm the air inside wash chamber 106 and a known fan unit (not shown in FIG. 1) for assisted convective airflow in wash chamber 106 to remove humidity from wash chamber 106 and dry washed items located therein. In one embodiment, the fan unit is attached to door assembly 120 and mixes moist air from wash chamber 106 with dry ambient air and forces the mixed air through a vent tube (not shown) in door assembly 120 according to known techniques. Air is discharged from the vent tube at a lower end of door assembly 120 and condensation from the air is collected and returned to dishwasher sump portion 142. The circulating air has been found to be a considerable aid to drying items in wash chamber 106 in a timely fashion.

In further and/or alternative embodiments, fan units may be employed in addition to, or in lieu of, the above-described fan unit attached to dishwasher door assembly 120. A variety of forced air circulation fans in different locations in dishwashers are found in the art, and references to fan and fan unit shall refer collectively to any fan element employed to assist in drying items in wash chamber 106. In other words, the inventive concepts described herein shall apply equally to various types of fan elements operable in a dry cycle mode of operation, rather than referring exclusively to a single fan element in a single location, such as the door mounted fan arrangement described above.

Figure 2:
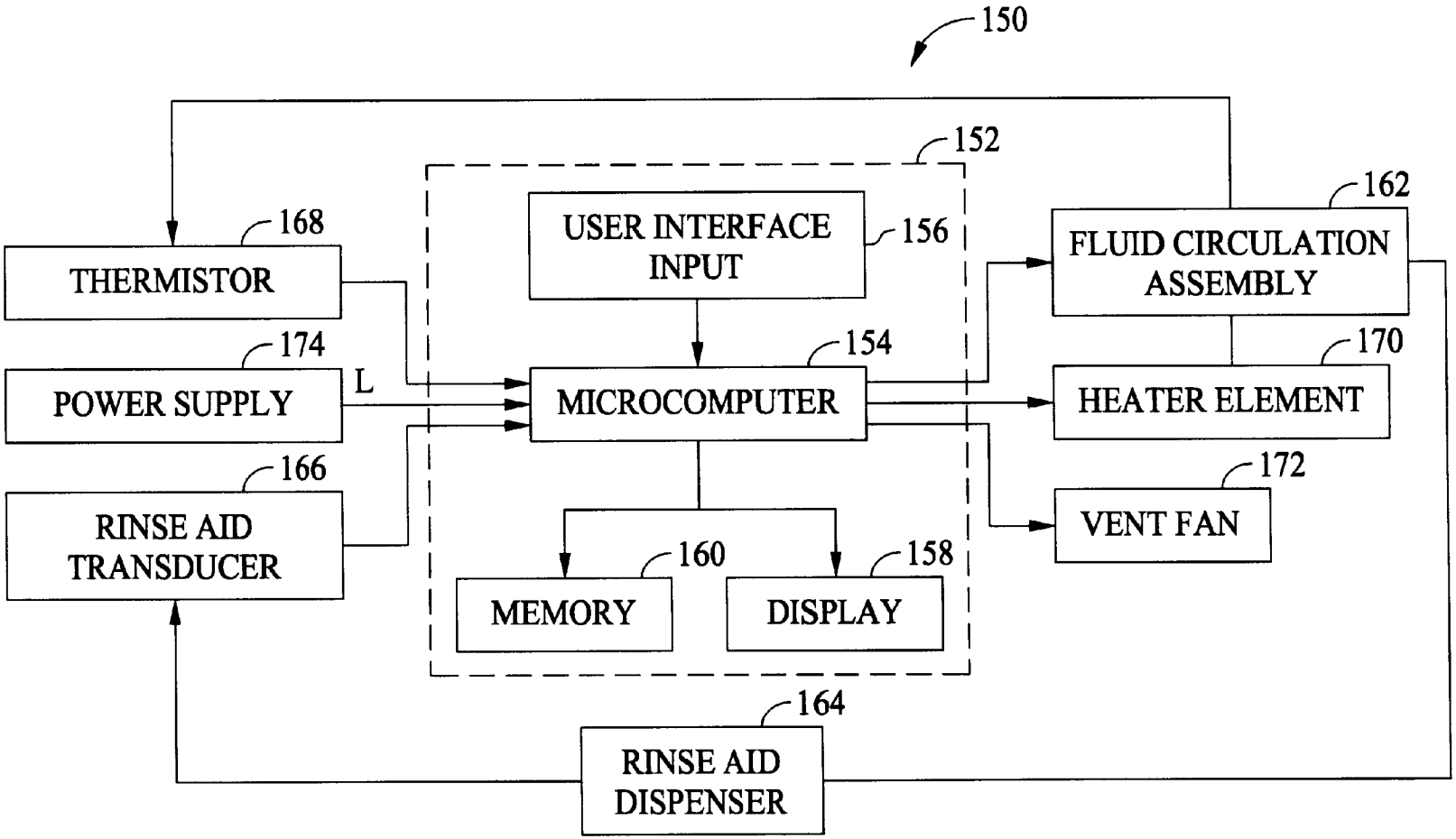
FIG. 2 is a schematic block diagram of the dishwasher system shown in FIG. 1.

FIG. 2 is a block diagram of a dishwasher control system 150 for use with dishwasher 100 (shown in FIG. 1). Control system 150 includes a controller 152 which may, for example, be a microcomputer 154 coupled to a dishwasher user interface input 156. An operator may enter instructions or select desired dishwasher cycles and features via user interface input 156, and a display 158 coupled to microcomputer 154 displays appropriate messages, indicators, a timer, and other known items of interest to dishwasher users. A memory 160 is also coupled to microcomputer 154 and stores instructions, calibration constants, and other information as required to satisfactorily complete a selected dishwasher cycle. Memory 160 may, for example, be a random access memory (RAM). In alternative embodiments, other forms of memory could be used in conjunction with RAM memory, including but not limited to electronically erasable programmable read only memory (EEPROM).

Power to system 150 is supplied to controller 152 by a power supply 174 configured to be coupled to a power line L. Analog to digital and digital to analog convertors (not shown) are coupled to controller 152 to implement controller inputs and executable instructions to generate controller output to a fluid circulation assembly 162 according to known methods. Fluid circulation assembly 162 includes a water pump, water heater, water filters, etc. to deliver washing fluids and rinses to spray-arm assemblies 144, 148 (shown in FIG. 1). In response to manipulation of user interface input 156, controller 152 monitors various operational factors of the dishwasher, and executes operator selected functions and features according to known methods. Of course, controller 152 may be used to control other dishwasher elements and functions beyond that specifically described herein.

Controller 152 operates the various components of fluid circulation assembly in a designated wash cycle familiar to those in the art, including dispensation of a known rinse aid product from a rinse aid product dispenser 164 in the final stages of the wash cycle. The rinse aid product is a known, commercially available composition, used separately from a detergent composition, to prevent spots and film formation on wash articles.

A transducer 166 is coupled to rinse aid dispenser 164 for signaling controller 152 of operating conditions of rinse aid product dispenser 164, which is influential on the efficacy of a dishwasher dry cycle. As used herein, transducer 166 is broadly defined as any device or component capable of detecting a presence or amount of rinse aid product in dispenser 164. For example, in an illustrative embodiment, transducer 166 is a known level switch that is tripped when the rinse aid product falls below a specified level. In alternative embodiments, transducer 166 may comprise a known gauge mechanism, an optical system, or other type of sensor mechanism to determine the presence and/or amount of rinse aid product in dispenser 164.

A thermistor 168 is also inputted to controller 152 and is used to monitor a temperature of wash chamber 106 (shown in FIG. 1). As used, herein, thermistor 168 is broadly defined as any temperature sensing element for determining an operating temperature of dishwasher 100 prior to commencement of a dishwasher dry cycle, which also is influential on the efficacy of the dry cycle. In an illustrative embodiment thermistor 168 is a known resistive element with a temperature variant resistance value. In other words, the resistance of the element fluctuates with the temperature of the element according to a known relationship, and by monitoring the voltage across thermistor 168, the temperature of thermistor 168 may be determined.

In an illustrative embodiment, thermistor 168 is located in dishwasher door assembly 120 (shown in FIG. 1) and in fluid communication with wash chamber 106 to monitor temperature conditions. In another embodiment, thermistor 168 is located in wash chamber 106 (shown in FIG. 1) itself to monitor operating temperature conditions of dishwasher 100 (shown in FIG. 1) in use. Conventionally thermistors are used for a variety of purposes in dishwasher operation, including but not limited to sensing of water temperature conditions to ensure, for example sanitation requirements of the wash cycle, and in a third embodiment, one of these existing thermistors may provide thermistor 168. For example, the thermistor in different embodiments is thermally coupled with water exiting the water pump to sense the temperature of the water in dishwasher tub 104 (shown in FIG. 1) and is located, for example, in a bottom of tub 104 and in fluid communication with the water stream discharged from a water pump inside dishwasher 100, or mounted to a pipe (not shown) to sense the water temperature before it exits the water pump.

It is contemplated that other temperature sensing components may be used in lieu of temperature sensitive resistive elements in thermistor 168 without departing from the scope of the present invention.

Once appropriately calibrated, signals supplied from rinse aid transducer 166 and thermistor 168 are used by controller 152 to determine an optimized dishwasher dry cycle wherein controller 152 operates a resistive heating element 170 and a vent fan unit 172 for mixing and circulating air to remove humidity from wash chamber 106 in a manner consistent with sensed operating conditions of transducer 166 and thermistor 168. Thus, items in wash chamber 106 may be appropriately dried in an energy inefficient manner. As will be seen, and unlike conventional dishwasher using fixed time dry cycles, controller 152 operates a dry cycle of a varying length depending on input conditions of the dishwasher through thermistor 168 and transducer 166.

For example, in an illustrative embodiment, a dry cycle mode is determined by a final rinse water temperature, and whether or not rinse aid product is present in rinse aid dispenser 164 when the dry cycle mode is entered. On-time duration values for heater element 170 and fan 172 are stored in controller memory 160 and indexed by microcomputer 154 according to input condition signals supplied by thermistor 168 and transducer 166. For example, a portion of an exemplary control scheme is set forth in the following look up table:

TABLE 1

| Final Rinse Temperature | Rinse Aid Present | Heater On-time | Fan On-time |
|---|---|---|---|
| 155° F. | No | 12 minutes | 24 minutes |
| 155° F. | Yes | 8 minutes | 18 minutes |
| 170° F. | Yes | 0 minutes | 15 minutes |

Thus, for example, if the temperature of wash chamber 106 is determined by controller 152 to be 155° F. as sensed by thermistor 168, and transducer 166 indicates that rinse aid product is present in dispenser 164, microcomputer 154 selects a heater time duration value of 8 minutes and a fan time duration value of 18 minutes from controller memory 160, and heater element 170 and fan 172 are energized accordingly. As the sensed temperature increases prior to energizing heater element 170 and fan 172, the heater-on time duration value and fan on-time duration value decrease, thereby conserving energy by applying only as much energy as dictated by operating conditions to adequately dry dishes and items therein. Also, time duration values are less when rinse aid product is present than when it is not. Excessive energy consumption of fixed time dry cycles conventionally employed in known dishwashers are therefore substantially eliminated.

Using the methodology set forth above, memory 160 may be located with maps or tables of various operating conditions and specific time duration values corresponding to sensed conditions for selection and execution by controller 152. Microcomputer 154, in a further embodiment, may interpolate between values in the look up table to determine appropriate time duration values for heater element 170 and 172. In yet another embodiment, microcomputer 154 directly calculates, according to derived or empirically determined mathematical relationships, optimal energy efficient heater element and fan on-time duration values for energy efficient operation in a dry cycle mode. In still another embodiment, controller memory 160 is loaded with offset constants to add or subtract to a pre-selected time duration value for heater element 170 and fan 172, thereby adjusting operation of heater element 170 and fan 172 as conditions dictate.

In a slightly more sophisticated approach, memory 160 is loaded with alternative values such as those set forth below:

TABLE 2

| Final Rinse Temperature | Rinse Aid Volume | Heater Element Pulses | Fan On-time |
|---|---|---|---|
| 0° C. to 45° C. | >2 cc | 17 | 30 |
| 0° C. to 45° C. | <2 cc | 20 | 30 |
| 45° C. to 55° C. | >2 cc | 12 | 30 |
| 45° C. to 55° C. | <2 cc | 19 | 20 |
| 55° C. to 65° C. | >2 cc | 6 | 20 |
| 55° C. to 65° C. | <2 cc | 13 | 10 |
| 65° C. to 70° C. | >2 cc | 3 | 10 |
| 65° C. to 70° C. | <2 cc | 10 | 10 |
| >70° C. | >2 cc | 0 | 10 |
| >70° C. | <2 cc | 7 | 10 |

Thus, under the above control scheme heater element on time (in terms of controller pulses rather than elapsed time) is less when rinse aid volume is above 2 cubic centimeters, and is more when rinse aid volume is less than 2 cubic centimeters at a given temperature. Also, heater element pulses decrease as the sensed temperature increases. Fan on-time is generally independent of rinse aid volume, but decreases as the sensed temperature increases.

Therefore, heater element 170 is operated for a reduced time, thereby producing less heat, as the temperature of wash chamber 106 increases, and is operated for an increased time, thereby generating more heat into wash chamber 106 as the temperature falls. Additionally, heater element 170 is operated for a reduced time at a given temperature when there is more than 2 cubic centimeters of rinse aid product in dispenser 164, thereby indicating sufficient levels of rinse aid product in the final rinse cycle that accordingly reduces a drying time of items in wash chamber 106, and heater element 170 is operated for an increased time at the same temperature when less than 2 cubic centimeters of rinse aid product is present in dispenser 164, thereby indicating insufficient amounts of rinse aid product in the final rinse cycle that accordingly increases a drying time for items in wash chamber 106. As such, heat is apportioned more commensurate with needs than in conventional systems, and unnecessary heating is generally avoided. Likewise, air circulation is apportioned more commensurate with needs than in conventional systems, and unnecessary air circulation is generally avoided. Thus, controller 152 executes a smart dry cycle taking into account the necessary considerations that govern energy efficiency. As compared to fixed time duration dry cycles executed in known dishwashing systems, control system 150 provides an economical, energy efficient alternative.

It should now be apparent that many variations of look up tables beyond those described may be employed in alternative embodiments while achieving at least some of the advantages of the instant invention and without departing from the scope of the present invention.

Figure 3:
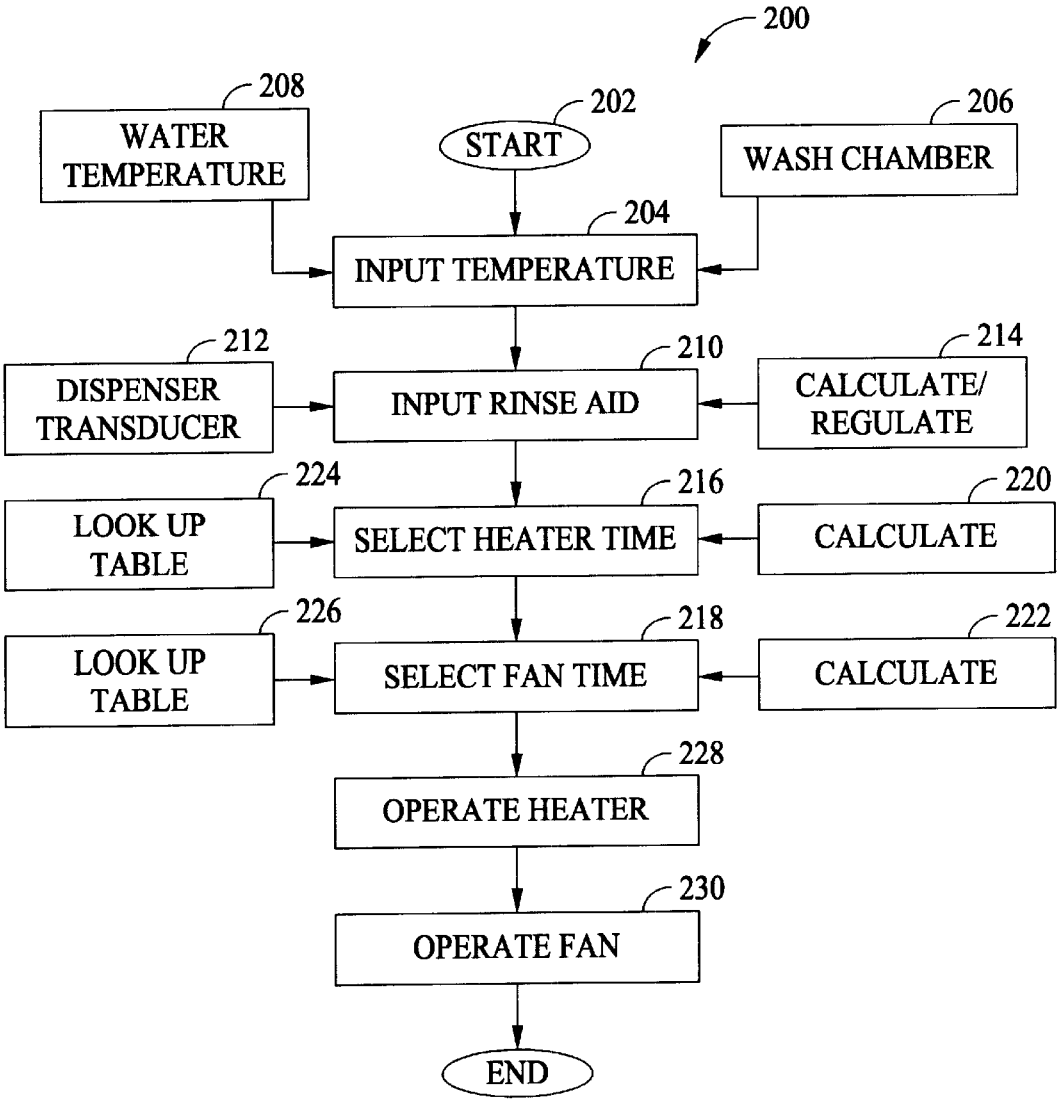
FIG. 3 is a flow chart of a variable dry cycle method executable by the system shown in FIG. 2.

FIG. 3 is a flow chart of a method 200 executable by controller 152 (shown in FIG. 2) to accomplish the foregoing advantages of an energy efficient variable length dishwasher dry cycle.

Once the activated by a user, such as with user interface input 156 (shown in FIG. 2), controller 152 begins by inputting 204 a temperature of dishwasher 100 (shown in FIG. 1). In illustrative embodiments, this may be accomplished by reading 206 a sensed temperature signal indicative of a temperature of wash chamber 106, or by reading 208 a signal indicative of a water temperature in a final rinse cycle. These signals may be generated by thermistor 168 (shown in FIG. 2) for processing by microcomputer 154 (shown in FIG. 2).

After inputting 204 a temperature signal, controller 152 also inputs 210 a condition of rinse aid product dispenser 164 (shown in FIG. 2). In illustrative embodiments, this may be accomplished by reading 212 a signal from transducer 166 or microcomputer 154 may calculate or regulate 214 an amount of rinse aid product being used in operation of the dishwasher.

Once dishwasher temperature and rinse aid volume are sensed, calculated or otherwise determined, controller 152 determines 216 a heater on-time duration value and also determines 218 a fan on-time duration value. In accordance with exemplary embodiments, respective time duration values are calculated 220, 222 by controller 152 or selected 224, 226 from a look up table, such as those described above. Once the heater element on-time duration value and fan on-time duration value are determined, controller 152 energizes and operates 228, 230 the respective heater element and fan unit accordingly for a time corresponding to the determined duration values.

While the invention has been described in terms of various specific embodiments, those skilled in the art will recognize that the invention can be practiced with modification within the spirit and scope of the claims.

What is claimed is:

1. A dishwasher comprising:

a wash chamber;

a thermistor for determining a temperature of said wash chamber;

a heater element located within said wash chamber for heating air in said wash chamber, and a controller operatively coupled to said heater element and to said thermistor, said controller configured to operate the heater element for a selected dry cycle time period determined by a thermistor reading of a final rinse water temperature.

2. A dishwasher in accordance with claim 1, the controller comprising a processor and a memory, said memory including a plurality of heater element dry cycle operation values for a plurality of thermistor readings.

3. A dishwasher in accordance with claim 1 further comprising a rinse aid product dispenser and a transducer operatively coupled to said rinse aid product dispenser.

4. A dishwasher in accordance with claim 3, said controller further configured to operate the heater element for a selected dry cycle time period based upon the transducer reading.

5. A dishwasher comprising:

a wash chamber;

a thermistor for determining a temperature of said wash chamber;

a heater element located within said wash chamber;

a fan unit; and a controller operatively coupled to said heater element, to said thermistor, and to said fan unit, said controller configured to execute a variable dry cycle wherein the heater element is energized for a selected time period determined by a thermistor reading of a final rinse water temperature and the fan is energized for a selected time period determined by the thermistor reading.

6. A dishwasher comprising:

a wash chamber a thermistor configured to determine a final rinse water temperature;

a heater element located within said wash chamber;

a fan unit;

a rinse aid product dispenser;

a transducer operatively coupled to said rinse aid product for determining an amount of a rinse aid product in the dispenser; and a controller operatively coupled to said heater element, to said thermistor, to said fan unit, and to said transducer, said controller configured to execute an energy efficient dry cycle wherein said fan unit and said heater element are energized for a time determined in response to the final rinse water temperature and signals from said transducer.

* * * * *